US008425657B2

(12) United States Patent
Ursem et al.

(10) Patent No.: US 8,425,657 B2
(45) Date of Patent: Apr. 23, 2013

(54) USE OF AN ELECTRIC FIELD FOR THE REMOVAL OF DROPLETS IN A GASEOUS FLUID

(75) Inventors: Willibrordus Nicolaas Johannes Ursem, Hellevoetsluis (NL); Johannes Cornelis Maria Marijnissen, Breda (NL); Rein André Roos, Nocé (FR)

(73) Assignee: Technische Universiteit Delft, Delft (NL)

( * ) Notice: Subject to any disclaimer, the term of this patent is extended or adjusted under 35 U.S.C. 154(b) by 354 days.

(21) Appl. No.: 12/808,736

(22) PCT Filed: Dec. 17, 2008

(86) PCT No.: PCT/NL2008/050805

§ 371 (c)(1),
(2), (4) Date: Sep. 14, 2010

(87) PCT Pub. No.: WO2009/078713

PCT Pub. Date: Jun. 25, 2009

(65) Prior Publication Data

US 2010/0326274 A1 Dec. 30, 2010

(30) Foreign Application Priority Data

Dec. 17, 2007 (EP) ..... 07123394

(51) Int. Cl.
*B03C 3/10* (2006.01)

(52) U.S. Cl.
USPC ..... 95/57; 95/77; 96/94; 96/97; 96/98

(58) Field of Classification Search ..... 95/57, 77, 95/79; 96/39–41, 94, 97–100
See application file for complete search history.

(56) References Cited

U.S. PATENT DOCUMENTS 3,768,258 A * 10/1973 Smith et al. ..... 60/275
4,734,105 A * 3/1988 Eliasson et al. ..... 95/62

(Continued)

FOREIGN PATENT DOCUMENTS

EP 1 010 810 6/2000
JP 54-11571 A * 1/1979 ..... 96/97

(Continued)

OTHER PUBLICATIONS

Uchiyama H. et al., "Development of an Electrostatic Fogliquefier and Its Field Experiments", Japanese Journal Applied Physics, Japan, Society of Applied Physics, Tokyo, JP, vol. 28, No. 11, Part 01, Nov. 1, 1989, p. 2319/2320, XP000086266, ISSN: 0021-4922.

(Continued)

*Primary Examiner* — Richard L Chiesa
(74) *Attorney, Agent, or Firm* — Gilberto M. Villacorta; Sunit Talapatra; Foley & Lardner LLP

(57) ABSTRACT

A method, and an apparatus to reduce and remove liquid droplets in air, such as fog, mist, haze, spray or steam. The mist and/or air borne water or other liquid droplets catching and collection apparatus creates an "electric wind", especially enforced by charged needle points or line arranged constructions and/or wires of the first electrode and an electric charging of mist and/or air borne water or other liquid droplets, which will be directed by the "electric wind" and the electric field between the electric source and the opposite grounded or opposite charged counter electrode (second electrode) of fine gauze or something comparable.

17 Claims, 8 Drawing Sheets

U.S. PATENT DOCUMENTS

| | | | | |
|---|---|---|---|---|
| 5,695,549 | A * | 12/1997 | Feldman et al. | 96/55 |
| 5,733,360 | A * | 3/1998 | Feldman et al. | 95/78 |
| 5,814,135 | A * | 9/1998 | Weinberg | 96/58 |
| 6,228,149 | B1 * | 5/2001 | Alenichev et al. | 95/78 |
| 6,287,368 | B1 * | 9/2001 | Ilmasti | 96/19 |
| 6,302,944 | B1 * | 10/2001 | Hoenig | 96/16 |
| 6,375,714 | B1 * | 4/2002 | Rump et al. | 95/3 |
| 6,585,803 | B1 * | 7/2003 | Chang et al. | 95/70 |
| 6,989,051 | B2 * | 1/2006 | Parisi et al. | 96/67 |
| 7,485,174 | B2 * | 2/2009 | Wang | 96/79 |
| 7,553,353 | B2 * | 6/2009 | Lepage | 96/3 |
| 7,601,204 | B2 * | 10/2009 | Woodruff et al. | 96/30 |
| 7,785,403 | B2 * | 8/2010 | Ouyang et al. | 96/18 |
| 2006/0214111 | A1 * | 9/2006 | Luo | 250/423 R |
| 2006/0278082 | A1 * | 12/2006 | Tomimatsu et al. | 96/66 |
| 2007/0261555 | A1 * | 11/2007 | Aubert | 96/66 |
| 2008/0034973 | A1 * | 2/2008 | Griffiths et al. | 96/58 |

FOREIGN PATENT DOCUMENTS

| | | |
|---|---|---|
| JP | 07-197428 | 8/1995 |
| WO | 2007/086091 | 8/2007 |

OTHER PUBLICATIONS

Uchiyama H. et al., "Field experiments of an electrostatic fog-liquefier", Journal of Electrostatics, Elsevier Science Publishers B.V. Amsterdam, NL, vol. 35, No. 1, Jul. 1, 1995, pp. 133-143, XP004040922, ISSN: 0304-3886, pp. 133-135.

International Search Report dated Mar. 26, 2009, from corresponding PCT application.

* cited by examiner

USE OF AN ELECTRIC FIELD FOR THE REMOVAL OF DROPLETS IN A GASEOUS FLUID

FIELD OF THE INVENTION

The present invention relates to the problem of mist or fog on roads, airfields, etc.

BACKGROUND OF THE INVENTION

Fog on airports and on freeways, highways and other roads form a serious risk and safety problem. Besides the safety aspect, there is also a traffic control problem on airports and on roads. The Dutch airport Schiphol normally transacts about 120 planes per hour. However, in case of fog this may reduce up to about 20 planes per hour, or even less in case of very heavy fog. The reduction of 100 planes per hour is a serious income loss and a problem for travellers. The problem may not only be the landing or take off, but may especially be the transfer of airplanes on the airport self: i.e. airplanes traffic control on the airport itself. If airports would be fog free, this would provide extreme business opportunities. Further, this would help travellers and transport and would provide a more economic use of time, fuels and money.

EP 1010810 describes an applying means in a discharge means which includes a set of electrodes, and the electrodes face the ground level, which are aligned along one continuous plane, are separated from each other at specified intervals in the horizontal direction, and are set to the same electrical potential. When the direct current high voltage is supplied from a power supply means, electric force lines are directed upward in the air above the applying means, producing charged particles based on corona discharge from the applying means. The charged particles absorb water in the air, condensing and binding into water, and dispersing the fog.

WO 2007086091 describes a crown effect apparatus with acceleration means for fog abatement which comprises means for ionising water vapour particles and means for collecting ionised water vapour particles. The ionising means are at a negative potential relative to the collecting means with consequent generation of a field of Coulomb forces between said means and determination of a displacement of the ionised particles and of their encounter with non ionised water particles and with the collecting means until the formation of water droplets is obtained. Means for accelerating the ionised particles are provided, such as a diffuser with fan, able to increase their relative speed in their displacement towards the collecting means (11). The accelerating means can also be constituted by a vehicle whereon the apparatus is mounted.

Uchiyama et al (J. of Electrostatics 35 (1995) 133-143, state that fog particles charged by corona discharge are attracted toward the inversely polarized electrode and instantaneously liquefied.

SUMMARY OF THE INVENTION

Fog abatement apparatus, seem not to be used in practice, or, if any is used at all, on a very limited scale. A reason may be that fog apparatus known from the prior art may not be effective in reducing fog in an economical way. For instance, apparatus proposed in the art use the principle of electrostatic precipitation, wherein large amounts of air have to be led through such apparatus, which is highly energy consuming. An apparatus, wherein air movement is not necessary, is therefore highly preferable.

Hence, it is an aspect of the invention to provide an alternative method for the removal of droplets in a gaseous fluid as well as an apparatus therefore, which preferably further at least partly obviate one or more of above-described drawbacks.

It is an aspect of the invention to provide the use of an electric field, especially in the range of about 0.1-100 kV/m, for the removal of droplets in a gaseous fluid. It is especially an aspect of the invention to provide the use of an electric field in the range of 0.1-100 kV/m for the removal of droplets in a gaseous fluid, wherein the electric field is applied between a first electrode, especially being a positive electrode arranged to generate a corona discharge, and a second electrode, especially being an earthed electrode, preferably comprising an air permeable electrically conductive sieve (also indicated as "conductive sieve" or "air-permeable conductive sieve") of preferably a air permeable conductive sieve of a plurality of conductive strands It is another aspect of the invention to provide a method for the removal of droplets in a gaseous fluid comprising applying an electric field to the gaseous fluid, especially a method wherein the electric field is an electric field in the range of about 0.1-100 kV/m. Especially, a method for the removal of droplets in a gaseous fluid is provided comprising applying an electric field in the range of 0.1-100 kV/m to the gaseous fluid, wherein the electric field is applied between a first electrode, being a positive electrode arranged to generate a corona discharge, and a second electrode being an earthed electrode, comprising an air permeable conductive sieve of a plurality of conductive strands having a shortest distance between adjacent conductive strands in the range of 0.01-500 mm. In a specific embodiment, the electric field is in the range of about 0.5-100 kV/m, even more especially in the range of about 2-100 kV/m, yet even more especially in the range of about 4-100 kV/m. Especially, the electric field may be smaller than about 50 kV/m, more especially smaller than 20 kV/m.

Preferably, the first electrode comprises a plurality of conductive needles (herein also indicated as "needles"). The first electrode comprising a plurality of needles can also be indicated as first electrode comprising a plurality of electrodes, since the plurality of needles are conductive needles, and thereby electrodes. Especially, the method further comprises arranging the plurality of conductive needles to point in the direction of the second electrode.

It is again another aspect of the invention to provide an apparatus for removing droplets from a gaseous fluid, wherein the apparatus comprises a first electrode and optionally a second electrode, wherein in a specific embodiment the first electrode is arranged to generate a corona discharge and arranged to generate an electric field in the range of about 0.1-100 kV/m. Especially, an apparatus for removing droplets from a gaseous fluid is provided, the apparatus comprising a first electrode arranged as positive electrode, especially arranged to generate a corona discharge, and arranged to generate an electric field in the range of 0.1-100 kV/m, and a second electrode being an earthed electrode, comprising an air permeable conductive sieve of preferably a plurality of conductive strands having a shortest distance between adjacent conductive strands in the range of 0.01-500 mm. In a specific embodiment, the second electrode comprises a conductive wire (including in an embodiment a cable) (especially a plurality of conductive wires; preferably arranged substantially parallel to each other), especially a conductive wire gauze (i.e. conductive gauze).

In yet another embodiment, the second electrode comprises a devices like a electrically conductive crash barrier, or a plurality of electrically conductive streetlamps, or a plurality of electrically conductive antennas, or in yet another embodiment reinforced concrete. Such devices may also function or be arranged as an air permeable conductive sieve.

Preferably, the first electrode comprises a plurality of conductive needles. Especially, the plurality of conductive needles are arranged to point in the direction of the second electrode.

The invention therefore surprisingly provides the use, a method, and an apparatus to reduce and remove liquid droplets in air, such as fog, mist, or haze, although the invention in specific embodiments might also be used to reduce and remove liquid droplets from a spray or steam. Hence, the invention provides a method to reduce or even remove gaseous fluids such as fog or mist.

The invention of the mist and/or air borne water or other liquid droplets catching and collection apparatus creates an "electric wind", especially enforced by charged needle points, or line arranged constructions, and/or wires of the first electrode and an electric charging of mist and/or air borne water or other liquid droplets, which will be directed by the "electric wind" and the electric field between the electric source and the opposite grounded or opposite charged counter electrode (second electrode), which is especially a (fine) gauze electrode.

BRIEF DESCRIPTION OF THE DRAWINGS

Embodiments of the invention will now be described, by way of example only, with reference to the accompanying schematic drawings in which corresponding reference symbols indicate corresponding parts, and in which.

DESCRIPTION OF PREFERRED EMBODIMENTS

Figure 1:
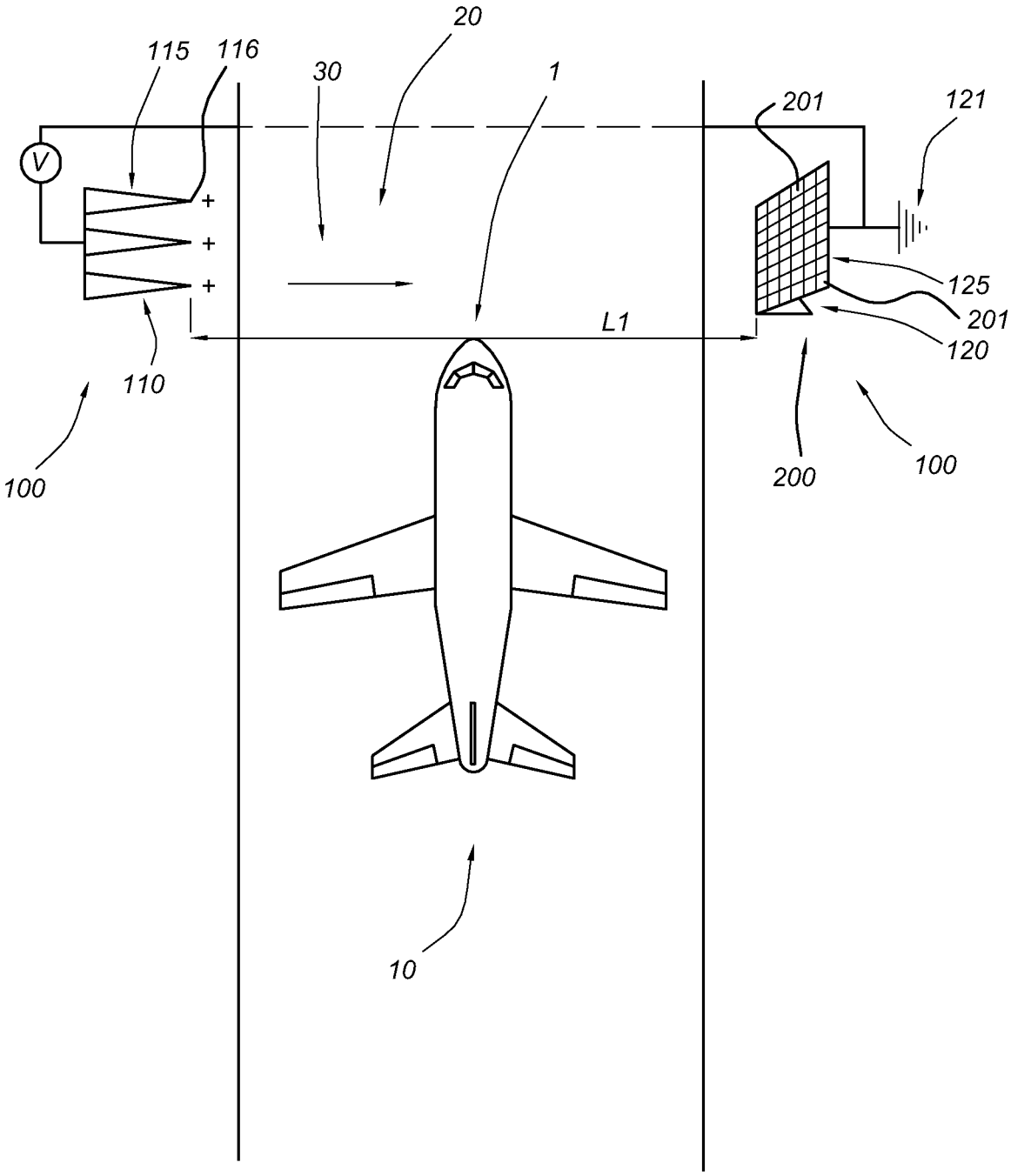
FIG. 1 schematically depicts, in top view, an air strip with an embodiment of the apparatus according to the invention.

In a specific embodiment, the electric field is applied between a first electrode 110, especially arranged to generate a corona discharge and especially arranged to generate an electric field in the range of about 0.1-100 kV/m, and a second electrode 120, comprising a conductive wire, here especially comprising a conductive wire gauze 125. In an embodiment, the second electrode is earthed 121 (as depicted). However, in another embodiment, the second electrode 120 may be isolated and may be neutral or negatively charged. Especially in such embodiments, the first electrode 110 and the second electrode 120 are electrically connected, as indicated in the schematic FIG. 1.

The electric field is indicated with reference number 30. The first and the second electrodes 110,120 are part of the apparatus of the invention, which is indicated with reference 100. In general, the second electrode 120 comprises an air permeable conductive sieve 200 (herein also indicated as "sieve") of a plurality of conductive strands 201 (see also FIG. 2*b*). As will be clear to the person skilled in the art, the term "conductive sieve 200" and "conductive strands 201", refer to electrically conductive sieve 200 and electrically conductive strand, respectively.

This especially means that a plurality of conductive strands 201, be it conductive wires, be it conductive bars, be it a conductive gauze, etc., which strands 201 may be regularly or irregularly arranged (or a combination thereof), form a kind of sieve, be it a 1D sieve (like a "comb"), a 2D sieve (like a gauze) or a 3D sieve (like a 3D gauze or 3D frame work of wires), with a shortest distance between adjacent conductive strands (see also below, which are large enough to allow air and fog pass through. However, due to the electric field 30, droplets present in a gaseous fluid may condense (or accumulate) at the strands 201, and the gaseous fluid, reduced in humidity, passes through the sieve 200. Preferably, in a 1D sieve, the strands are arranged substantially parallel. In a 2D sieve, in an embodiment subsets of strands may be arranged substantially parallel, but the subsets may be arranged under an angle. In yet another embodiment, the 2D sieve is arranged to provide square or rectangular meshes. In yet another embodiment, the 2D sieve is arranged to provide pentagonal, hexagonal, heptagonal or octagonal meshes, especially hexagonal meshes. Crossing strands may be knotted or fused. The person skilled in the art know types of different gauzes. 3D gauzes can be similar as 2D gauzes, but than in 3 directions.

The second electrode 120, especially the air permeable conductive sieve 200, is a device having in an embodiment a substantially flat front (1D sieve or 2D sieve, etc.), formed by a plurality of strands 201, that is arranged to be directed to the first electrode 110. More especially, the curved features (see below) of the first electrode 110, such as the needles, substantially point in the direction of the second electrode 120, more especially the air permeable conductive sieve 200. Preferably, the needles and the second electrode 120 are arranged to be perpendicular to each other (see also a number of accompanying drawings).

The electric field 30 is especially a static electric field. In a further embodiment, there may be a modulation on the electric field 30. Such modulation may be an on-off modulation, or may be a modulation on a constant value (for instance a sinusoidal modulation). However, the modulation is essentially not such, that the direction of the electric field 30 is inverted. Hence, referring to FIG. 1, although temporarily the first electrode 110 might be uncharged, when charged, the charge is especially positive.

Figure 3:
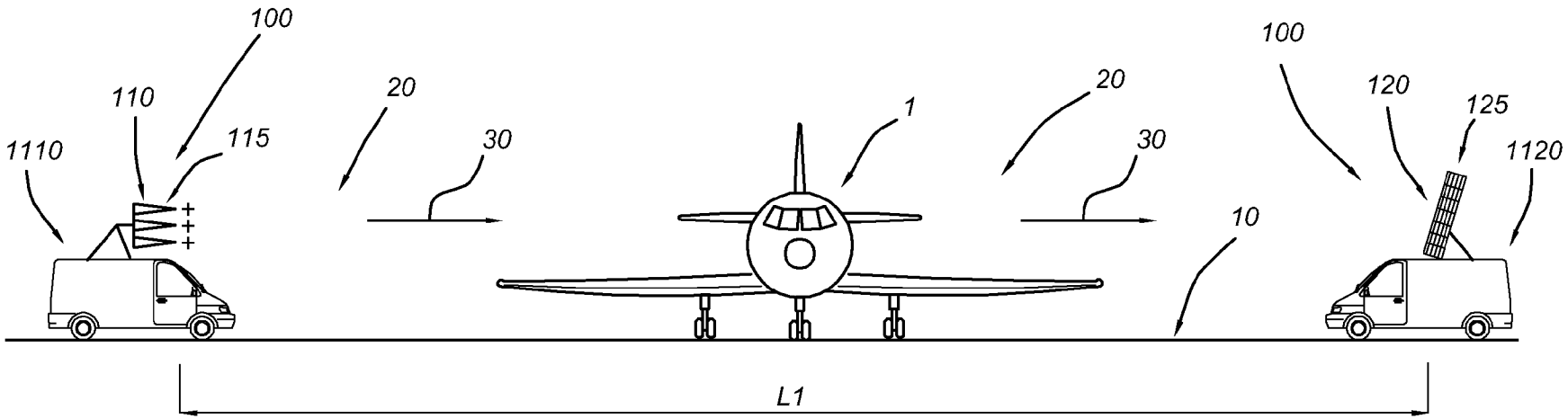
FIG. 3 schematically depicts, in front view, an air strip with another embodiment of the apparatus according to the invention.

In another specific embodiment, a shortest distance between the first electrode 110 and the second electrode 120 is in the range of about 0.05-500 m, such as especially 5-500 m, especially in the range of about 5-50 m, more especially in the range of about 5-25 m. In FIGS. 1 and 3, the shortest distance is indicated with reference L1. Especially, the shortest distance between the first electrode 110 and the second electrode 120 may be in the range of about 0.05-100 m, such as 0.2-100 m, especially 0.5-100 m, and in an embodiment 5-100 m.

FIG. 1 schematically depicts one gauze 125; however, as will be clear to the person skilled in the art, a plurality of gauzes 125 may be applied; i.e. the apparatus 100 may comprise a plurality of second electrodes 120, especially a plurality of conductive gauzes 125. As mentioned above, these gauzes 125 may be arranged in an isolated way (i.e. not grounded). Thus, the air permeable conductive sieve 200 here comprises a gauze 125. The schematic drawing depicts a 2D arrangement of conductive strands 201. The schematic drawing shows a subset of substantially parallel strands 201 and perpendicular thereto another subset of substantially parallel strands 201. The distances between substantially parallel strands (i.e. d2 and d3, see below), such as wires or bars, or the maze of the gauze 125, which may be used as second electrode 120, may especially between 0.01-500 mm, such as about 0.05-50 mm Referring to FIG. 1, in an embodiment the first electrode 110 may be a fixed electrode; i.e. a post or another item fixed for instance to the ground, to which the first electrode 110 is attached. In other words, in an embodiment, the first electrode 110 is not arranged to be movable.

Figure 2A:
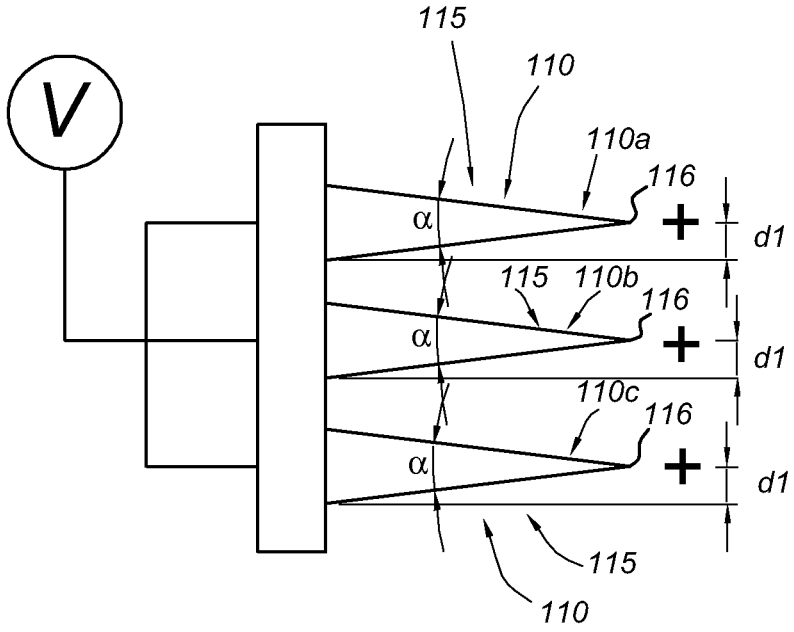
FIGS. 2*a* and 2*b* schematically depict in more detail the first and the second electrodes, respectively, of embodiments of the apparatus according to the invention.
Figure 2B:
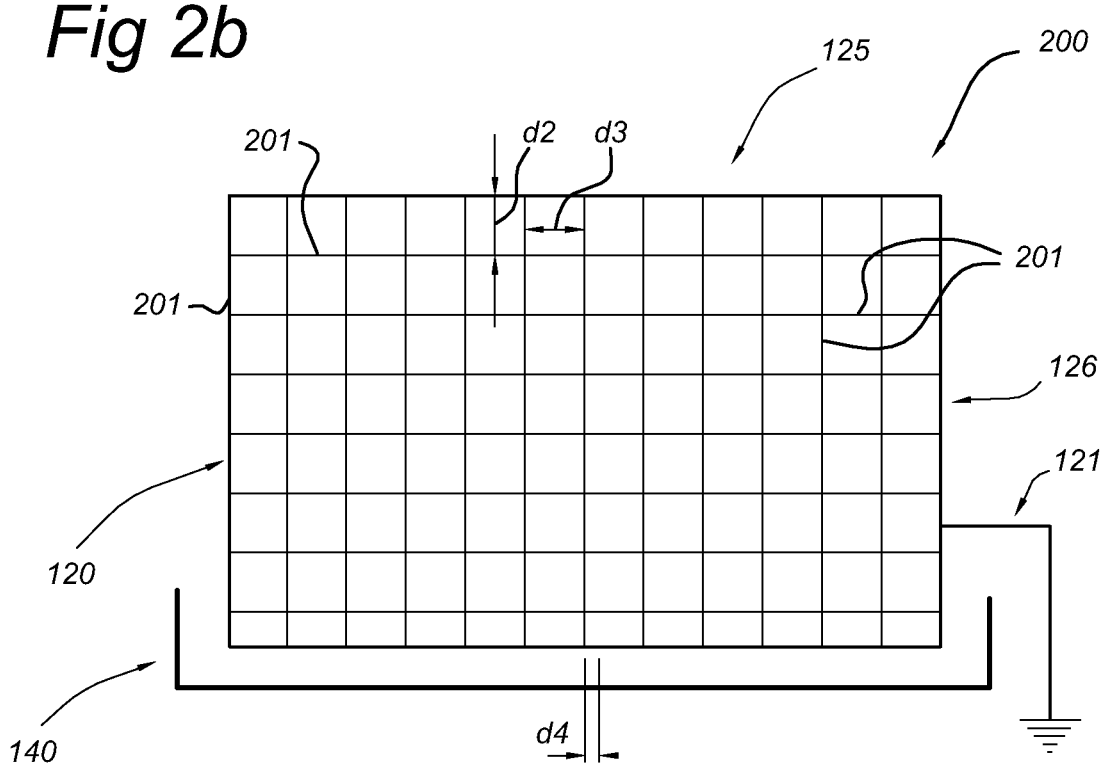

Referring to FIG. 1, in an embodiment the second electrode 120 may be a fixed electrode; i.e. a post or another item fixed for instance to the ground, to which the second electrode 120 is attached. In other words, in an embodiment, the second electrode 120 is not arranged to be movable. In FIGS. 1 and 2*b*, a kind of fence (gauze) is used as second electrode 120.

Hence, in this way, the electric field 30 is applied between the first electrode 110 arranged to generate a corona discharge, and the second electrode 120 comprising a conductive wire, especially a conductive wire gauze 125, wherein in an embodiment the first electrode 110 comprises a plurality of first electrodes (110*a*, 110*b*, . . . ) (see also FIG. 2*a*) (such as a plurality of needles), and wherein in an embodiment the second electrode 120 comprises a plurality of conductive strands, such as wires, especially a (plurality of) conductive air permeable sieves 200, such as a plurality of wire gauze(s) 125, respectively (see also FIG. 4*a*), and wherein the first electrodes 110*a*, 110*b*, etc. and the plurality of conductive wires, especially the (plurality of) conductive wire gauze(s) 125, respectively, are arranged at fixed positions and are arranged to generate the electric field 30 over the one or more geographical objects selected from the group consisting of a road, an open place, a runway, an airstrip and a built-on area; especially over the one or more geographical objects selected from the group consisting of a road, an open place, a runway, and an airstrip.

In a specific embodiment, the first electrode 110 is arranged on a motorized vehicle 1110, or the second electrode 120 is arranged on a motorized vehicle 1120, or both the first electrode 110 and the second electrode 120 are arranged on motorized vehicles (1110, 1120). Hence, in a specific embodiment, the apparatus 100 further comprises one or more motorized vehicles, wherein the first electrode 110 is arranged on first motorized vehicle 1110, or the second electrode 120 is arranged on motorized vehicle 1120, or both the first electrode 110 and the second electrode 120 are arranged on motorized vehicles 1110,1120, as schematically depicted in the embodiment of FIG. 3.

The invention may especially be applied for reducing fog or mist over one or more geographical objects selected from the group consisting of a road, an open place, a runway, an airstrip and a built-on area; more especially a road, an open place, a runway, and an airstrip. However, the invention may also be applied for other applications, such as reduction or removal over small distances of the gaseous fluid, such as one or more gaseous fluids selected from the group consisting of fog, mist, haze, spray and steam. The schematic drawings 1 and 3 show an airstrip 10; but the invention is not limited to only applications to gaseous fluids over airstrips. Herein, the term "road" especially relates to paved roads which are designed for transport of motorized vehicles such as cars, automobiles, trucks, or motors. Herein the terms "runway" or "airstrip" (indicated with reference 10) especially relate to paved roads which are designed for take-off and/or landing of airplanes or aircrafts (indicated in FIGS. 1 and 3 with reference 1).

Referring to FIGS. 1 and 3, the invention is further also directed to a combination of (a) a road, selected from the group consisting of runways, airstrips and paved roads for automobiles, and (b) an apparatus 100 for removing droplets from a gaseous fluid 20, the apparatus 100 comprising first electrode 110 arranged to generate a corona discharge and arranged to generate an electric field in the range of about 0.1-100 kV/m over at least part of the road and preferably also second electrode 120, as described herein.

In a specific embodiment, the gaseous fluid comprises one or more gaseous fluid selected from the group consisting of fog, mist, haze, spray and steam. In the figures, the gaseous fluid is indicated with reference 20, and especially comprises fog, mist or haze. Herein, the term "removal of droplets in a gaseous fluid" may relate to the effective removal of fog, mist or haze, etc. With the method of the invention, the humidity in the fluid may be reduced, thereby effectively reducing or even removing the fog, mist or haze, and improving transmission of visible light through the gaseous fluid. The fog, mist or haze may be reduced and the gaseous fluid, such as air, may clear up.

In a specific embodiment, the first electrode 110 comprises a plurality of electrodes, such as a plurality of electrically conductive needles, wherein the plurality of electrodes are arranged to generate corona discharges. In FIG. 2*a*, the plurality of electrodes is schematically shown with reference numbers 110*a*, 110*b*, 110*c* . . .

In a preferred embodiment, the first electrode 110 comprises one or more conductive curved features or conductive needles (indicated with reference 115) having one or more dimensions in the range of for instance about 0.1 μm-0.5 mm. The curved feature may for instance comprise a wire, a wire mesh, an antenna or a needle, especially with the above defined dimensions. Especially needle like features are applied. Conductive needles are herein further indicated as needles. Needles are especially conductive protrusions or pins having mean aspect ratios (mean: i.e. mean over the length of the needle) in the range of about 5-2000 (i.e. length/(mean thickness or mean diameter)), especially 10-2000, even more especially 20-2000. Hence, in a specific embodiment, the first electrode 110 comprises one or more, especially a plurality, such as 4-10,000, curved features 115, especially needles. The curved features 115, especially the needles, may have one or more dimensions, i.e. especially thickness, in the range of about 0.1 μm-0.5 mm, especially 1 μm-0.5 mm, more especially 10 μm-0.5 mm, even more especially 100 μm-0.5 mm, such as 10 μm-0.1 mm. Hence, the first electrode 110 especially comprises sharp points or needles. In general, the sharper the needle, the better.

In the figures, the curved features 115 are indicated as (sharp) needles, although also wires (optionally including cables), a wire gauze, etc. could be used. It is preferred the curved features have one or more dimensions in the range of about 0.1 μm-0.5 mm, which dimensions allow corona discharges. In FIG. 2*a*, curved features 115 are indicated, which have a dimensions d1 (here thickness or diameter). Here, the one or more dimensions might be diameter or thickness. The length of such curved features 115 (e.g. needle length; i.e. longitudinal length) may especially be in the range of about 0.5 mm-100 cm, especially in the range of about 5 mm-50 cm. Such curved features 115 may have angles of 140° or less, especially 90° or less, even more especially, 50° or less. These angles are in the schematic embodiment of FIG. 2*a* indicated with reference α. Especially preferred angles α are in the range of about 5-140°, more especially in the range of about 5-90°, yet even more especially in the range of about 5-50°, or even smaller. The tips of the curved features 115, here especially the tips of the needles, are indicated with reference number 116.

Hence, the figures also schematically show an embodiment of the apparatus 100, wherein the first electrode 110 comprises a plurality of conductive needles. Especially, the plurality of conductive needles are arranged to point in the direction of the second electrode 120 (as for instance shown in FIG. 1).

A corona is a process by which a current, perhaps sustained, develops from an electrode with a high potential in a neutral fluid, usually air, by ionizing that fluid so as to create a plasma around the electrode. The ions generated eventually pass charge to nearby areas of lower potential, or recombine to form neutral gas molecules. When the potential gradient is large enough at a point in the fluid, the fluid at that point ionizes and it becomes conductive. If a charged object has a sharp point, the air around that point will be at a much higher gradient than elsewhere. Air near the electrode can become ionized (partially conductive), while regions more distant do not. When the air near the point becomes conductive, it has the effect of increasing the apparent size of the conductor. Since the new conductive region is less sharp (or curved), the ionization may not extend past this local region. Outside of this region of ionization and conductivity, the charged particles slowly find their way to an oppositely charged object and are neutralized. If the geometry and gradient are such that the ionized region continues to grow instead of stopping at a certain radius, a completely conductive path may be formed, resulting in a momentary spark, or a continuous arc. Corona discharge usually involves two asymmetric electrodes; one highly curved (such as the tip of a needle, or a small diameter wire) and one of low curvature (such as a plate, or the ground, or the herein indicated gauze). The high curvature ensures a high potential gradient around one electrode, for the generation of a plasma.

Electric charges on conductors reside entirely on their external surface (see Faraday cage), and tend to concentrate more around sharp points and edges than on flat surfaces. This means that the electric field generated by charges on a curved conductive point is much stronger than the field generated by the same charge residing on a large smooth spherical conductive shell. When this electric field strength exceeds what is known as the corona discharge inception voltage (CIV) gradient, it ionizes the air about the tip, and a small faint purple jet of plasma can be seen in the dark on the conductive tip. Ionization of the nearby air molecules result in generation of ionized air molecules having the same polarity as that of the charged tip. Subsequently, the tip repels the like-charged ion cloud, and the ion cloud immediately expands due to the repulsion between the ions themselves. This repulsion of ions creates an "electric wind" that emanates from the tip.

This "electric wind" is especially directed in the direction of the second electrode 120. Hence, even if grounded, the electric wind may be directed to the second electrode 120. Hence, the second electrode 120 is especially an electrode that allows on the one hand propagation of the gaseous fluid, but on the other hands allows condensation or collection of the droplets in the gaseous fluid 20. Hence, the second electrode 120 is especially in an embodiment a wire, more especially a plurality of wires or bars, which are arranged substantially parallel, like a 1D raster, or a plurality of wires or bars arranged as a gauze 125 (which may be indicated as 2D raster). The distance between the wires or bars, or the maze of the gauze 125, which may be used as second electrode 120, may especially between 0.01-500 mm, such as about 0.05-50 mm (or for instance 0.1 μm up to 0.5 mm), so that the charged and/or uncharged droplets may aggregate on the wires or gauze and flow or wash down because of the gravity force into for instance a gutter or any other drain or water catch system.

Herein, in an embodiment, the term "wire" or "conductive wire" may also relate to "cable" or "conductive cable", respectively.

Hence, in a specific embodiment, the electrically conductive air permeable conductive sieve 200, such as in an embodiment the wire gauze 125 comprises meshes with one or more dimensions (such as length, width or diameter) in the range of about 0.01-500 mm, such as preferably 0.01-10 mm, especially in the range of about 0.05-5 mm, even more especially 0.1 μm up to 0.5 mm. These dimensions let the fluid 20 pass through the sieve 200, and allow the droplets accumulate at the conductive strands 201. The dimensions are schematically depicted in FIG. 2*b*, wherein d2 and d3 indicate distances between neighbouring (i.e. adjacent) wires (i.e. the length and width), indicate with reference 126, gauze 125. Yet in another embodiment, the second electrode 120 comprises a plurality of conductive wires (including cables) which are arranged substantially parallel, and the distance between the wires is in the range of about 0.01-500 mm, such as 0.01-10 mm, especially in the range of about 0.05-5 mm (even more especially 0.1 μm up to 0.5 mm). Herein, the term "plurality of wires" especially relate to about 4-500 of such wires. Such gauzes 125 or plurality of wires may effectively catch the droplets and scavenge the droplets from the gaseous fluid 20.

Hence, in a specific embodiment, wherein the second electrode 120 comprises a plurality of wires, be it arranged substantially parallel or be it arranged in a wire gauze, the longest distance between two adjacent substantially parallel arranged wires is preferably in the range of 0.01-500 mm, especially 0.01-10 mm, especially in the range of about 0.05-5 mm, such as especially 0.5-5 mm, such as especially about 0.05-50 mm, even more especially 0.5-10 mm (even more especially 0.1 μm up to 0.5 mm).

Therefore, the second electrode comprises conductive strands, wherein a shortest distance between adjacent (substantially parallel arranged) strands is 0.01-500 mm, especially 0.05-500 mm, even more especially 0.05-500 mm, such as 0.5-50 mm, or 0.5-10 mm, preferably 0.5 50 mm.

Figure 2C:
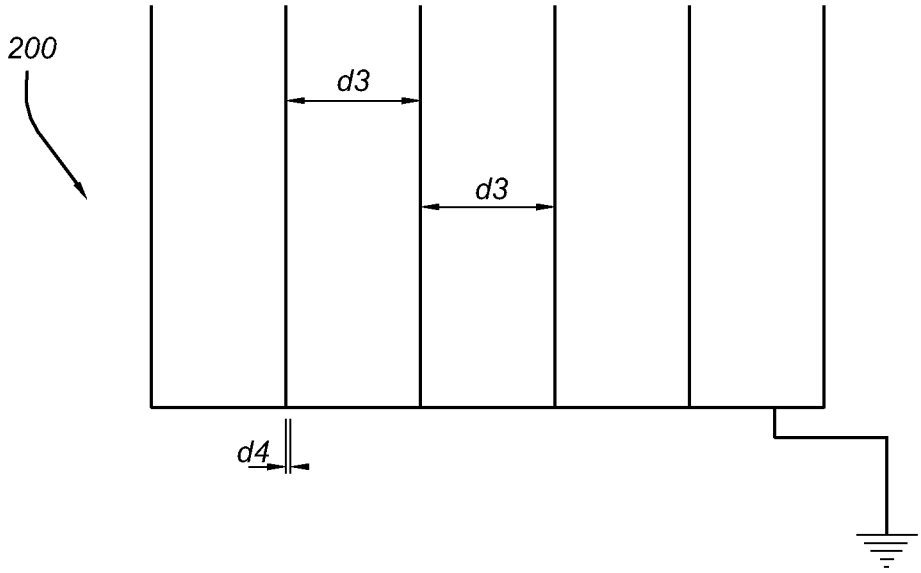
FIG. 2*c* schematically depicts an embodiment of the second electrode.

In a 1D sieve, a shortest distance may be the shortest distance between two adjacent strands 201, such as indicated with d3 in FIGS. 2*b* and 2*c*. In a 2D sieve, such as depicted in FIG. 2*b*, a shortest distance may be a diameter, but may also be a length and/or a width, i.e. d2 and d3, respectively. Preferably at least 1 of these distances fulfils the condition that the shortest distance between adjacent conductive strands is about 0.01-500 mm. It is not necessary that also the other distance fulfils this condition, although in a preferred embodiment, this is the case. Likewise, in a 3D sieve (not depicted) a shortest distance may be a diameter, but may also be a length and/or a width and/or a depth. Preferably at least 1 of these distances fulfils the condition that the shortest distance between adjacent conductive strands is about 0.01-500 mm. It is not necessary that also the other distance fulfils this condition, although in a preferred embodiment, this is the case. Distances d1 and d2, etc. are especially shortest distances between substantially parallel arranged strands 201.

In systems wherein meshes are present, such as in 2D gauzes, such meshes may have any shape, and in such systems, as a shortest length between adjacent strands, the mesh diameter may be chosen.

The dimensions of the conductive strands 201, indicated with reference d4, which may, dependent upon the type of conductive strands 201 be the diameter, or the mean diameter, or the width(s), are preferably in the range of about 0.05-50 mm, especially in the range of about 1-20 mm.

In an embodiment, not depicted, the air permeable electrically conductive sieve comprises a plurality of substantially parallel arranged electrically conductive plates. Again, this may be a 1D arrangement or a 2D arrangement. The distances between substantially parallel plates (i.e. d2 and d3), or the maze of the "plate" gauze 125, which may be used as second electrode 120, may especially between 0.01-500 mm, such as about 0.05-50 mm. The invention is further herein described by using a plurality of strands. Therefore, in an embodiment, the invention also provides an apparatus for removing droplets from a gaseous fluid, comprising a first electrode arranged as positive electrode, arranged to generate a corona discharge and arranged to generate an electric field in the range of 0.1-100 kV/m, and a second electrode being an earthed electrode, comprising an air permeable conductive sieve of a plurality of electrically conductive plates having a shortest distance between adjacent conductive plates in the range of 0.01-500 mm.

Figure 2D:
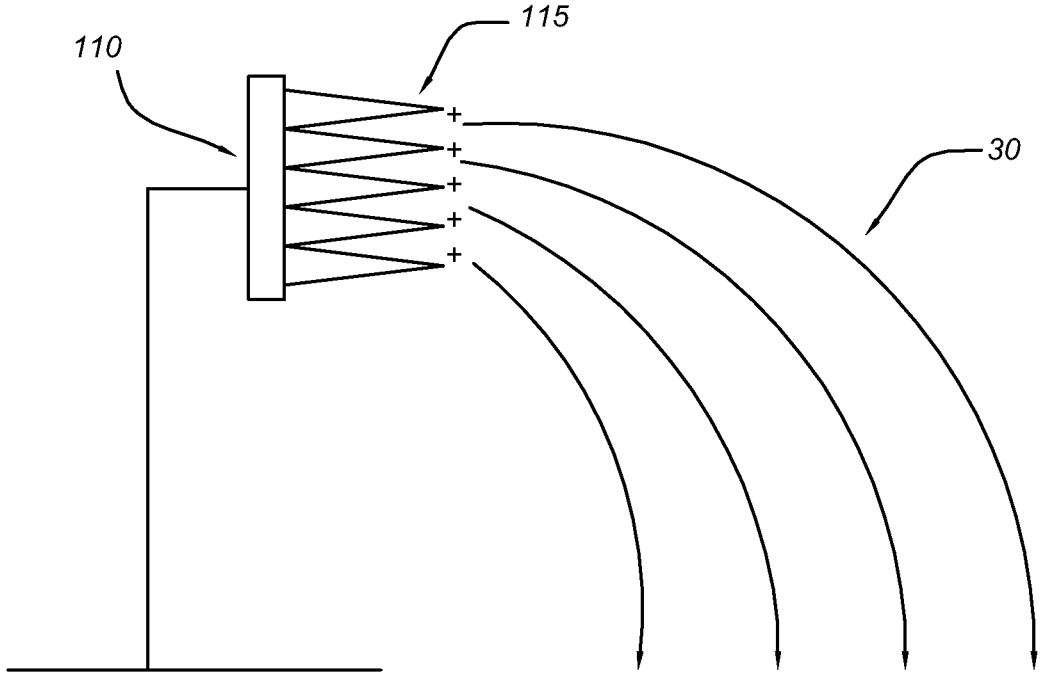
FIGS. 2*d* and 2*e* schematically depict the influence of the second electrode.
Figure 2E:
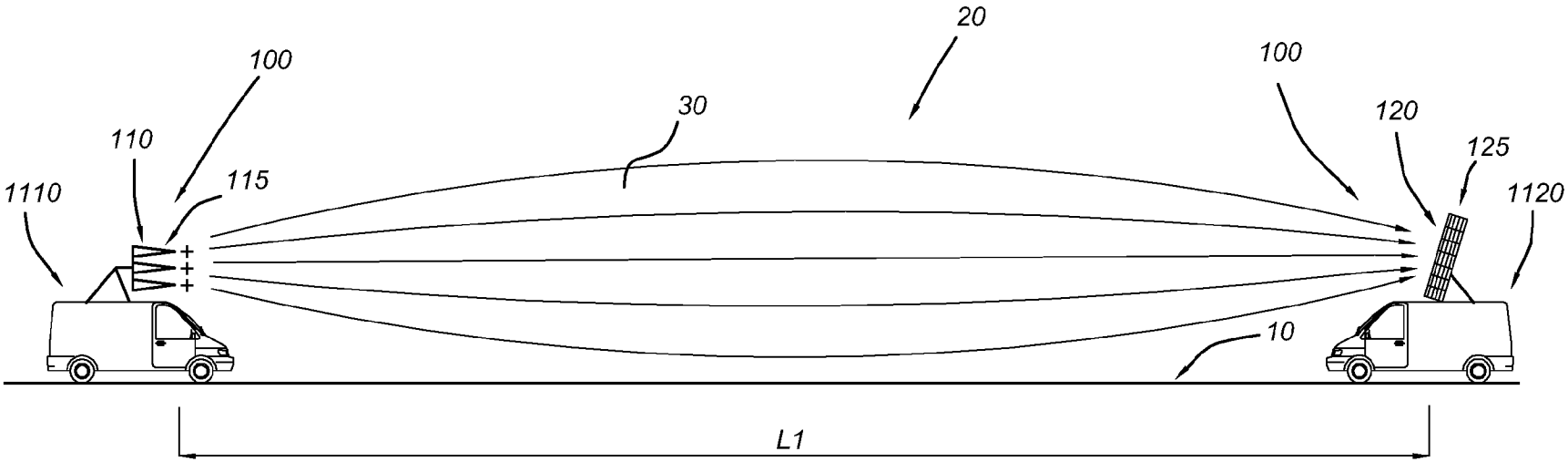

FIG. 2*c* schematically depicts a 1D (array) of conductive strands 201, arranged as a kind of fence, as sieve 200. The meshes are indicated with reference d3. The meshes may vary over the sieve 200. FIGS. 2*d* and 2*e* schematically depict the field 30 when the second electrode 120 is absent (for example FIG. 2*d*) or present (2*e*). Only in the latter embodiment, i.e. the use of a (positively) charged first electrode 110, and a counter electrode (second electrode 120) the advantages of the invention may be achieved. Especially, the first electrode 110 comprises a plurality of needles. Note that in FIG. 2*e* the second electrode 120, especially thus the air permeable conductive sieve 200, is arranged under an edge (i.e. "slanted") relative to a virtual prolongation ("longitudinal axis" or "needle axis", see below) of the needles. Preferably however, the second electrode 120 is not slanted relative to the needles of the first electrode 110. Preferably, the needles and second electrode, especially thus the air permeable conductive sieve 200, are arranged perpendicular, in the sense that the (plurality of) electrode(s) point in the direction of the second electrode 120.

FIG. 3 has been described above.

As mentioned above, the "electric wind" is especially directed in the direction of the second electrode 120. Hence, in a specific embodiment, the first electrode 110 and the second electrode 120 are arranged to generate an electric wind in the direction of the second electrode 120. Amongst other, this may be done by providing an isolated second electrode 120 with especially a negative charge (during use of the apparatus 100). Further, this might also be done by directing the curved features 115, especially the needles, in the direction of the second electrode 120. Especially in the case of shorter distances such as about 1-25 m, especially 5-25 m, arranging the curved features 115 in such a way that the tips 116 are aligned in the direction of the second electrode 120, may allow generating an electric wind in the direction of the second electrode 120, thereby driving the gaseous fluid 20 in the direction of the second electrode 120, where droplets condense on the (plurality of) wires of the electrode 120 or the wires 126 of the gauze 125 (see FIG. 1). Arranging a collector below the second electrode 120 may allow further collection of the droplets. Hence, in a specific embodiment, the second electrode 120 further comprises a collector 140, arranged to collect droplets collected by the second electrode 120. Such collector 140 especially uses gravity, to collect the droplets. The droplets may aggregate or condense at the strands 201, such as wires, and fall by gravity, where the collector 140 collects the droplets. Collector 140 may for instance be a gutter or a drain.

The droplets, especially water droplets, will in general be in the order of about 0.01 μm-3 mm, more especially about 0.1 μm-0.1 mm. As indicated above, the second electrode 120 may be arranged to allow the gaseous fluid 20 flow through the second electrode 120 but substantially block a major part of the droplets comprised by the gaseous fluid.

Herein, the term conductive is known in the art, but especially refers to a resistivity of about $1\cdot10^{-9}$ Ω·m (at 20° C.) or less.

In yet another embodiment, the first electrode 110 or the second electrode 120 or the first electrode 110 and the second electrode 120 of apparatus 100 is part of or integrated with an object comprising street furniture, for instance a sound barrier, a crash barrier, a tunnel wall, a road sign, a traffic information system, a street lamp, and a traffic light. In such embodiments, the first electrode 110, or the second electrode 120, respectively, are not arranged to be movable.

Figure 4A:
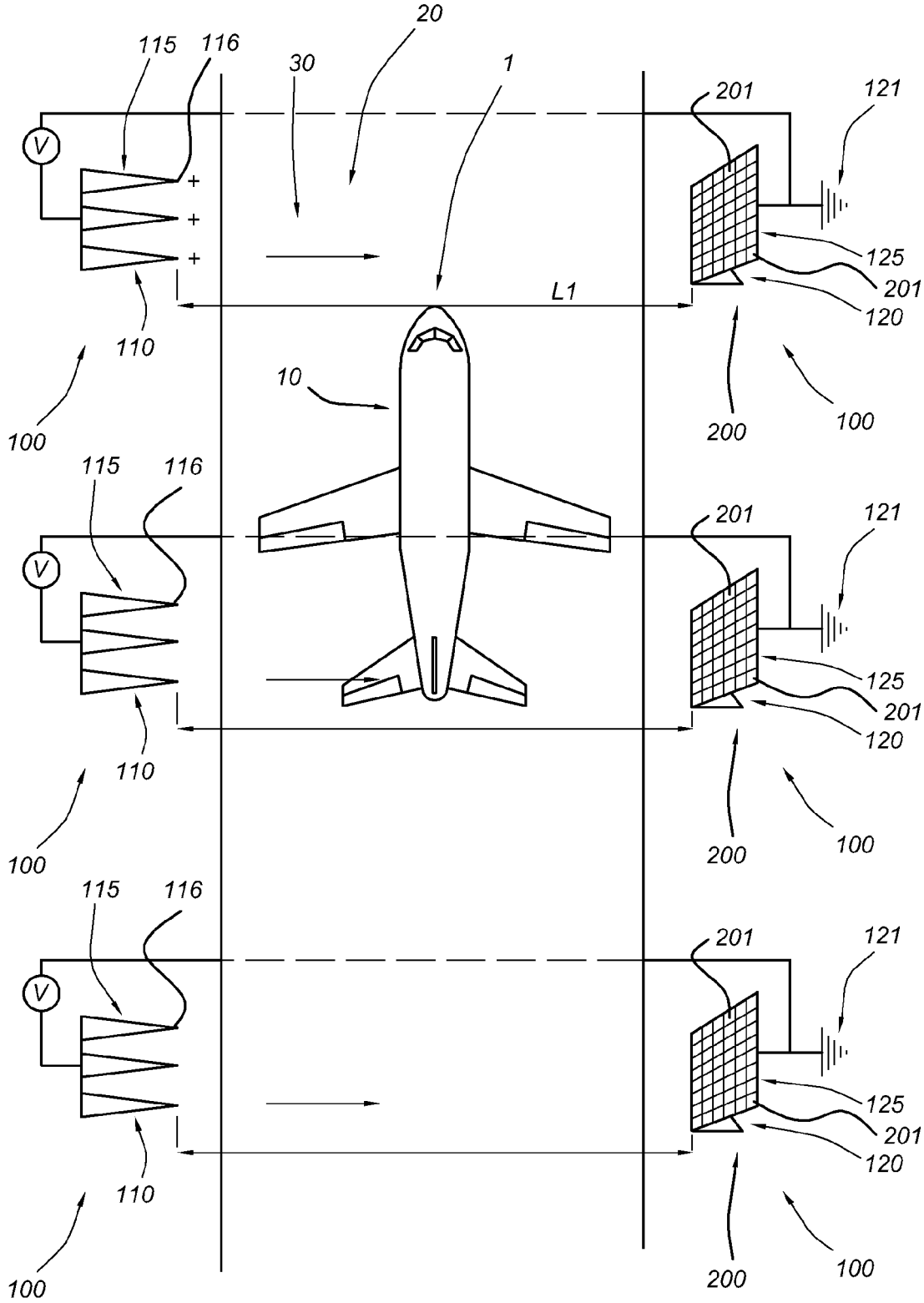
FIGS. 4*a*-4*d* schematically depict some other embodiments related to the invention.

As mentioned above, also a plurality of first 110 and second electrodes 120 may be applied, wherein sets of first and second electrodes 110,120, are arranged opposite of each other, at a distance L1. In between the electrodes 110,120, a geographical object, such as an road, may be arranged. An example thereof is schematically depicted in FIG. 4*a*. Hence, FIG. 4*a* schematically depicts an embodiment wherein the first electrode comprises 110 a plurality of first electrodes 110, and wherein the second electrode 120 comprises a plurality of second electrodes 120, here air permeable electrically conductive sieves 200, and wherein the first electrodes 110 and the plurality of air permeable conductive sieves 200, are arranged at fixed positions and are especially arranged to generate the electric field over the one or more geographical objects selected from the group consisting of a road, an open place, a runway, an airstrip and a built-on area. In yet another embodiment, the geographical object is a built in area as a small construction.

Further, preferably, second electrodes 120 accompanying first electrodes, respectively, are arranged at one side of the first electrode 110. Or, in other words, in case the first electrode 110 is arranged to be accompanied by a plurality of second electrodes 120 (especially in order to perform the method of the invention), these second electrodes are preferably arranged at one side of the first electrode 110, and are preferably thus not arranged to enclose or surround the first electrode 110.

Figure 4B:
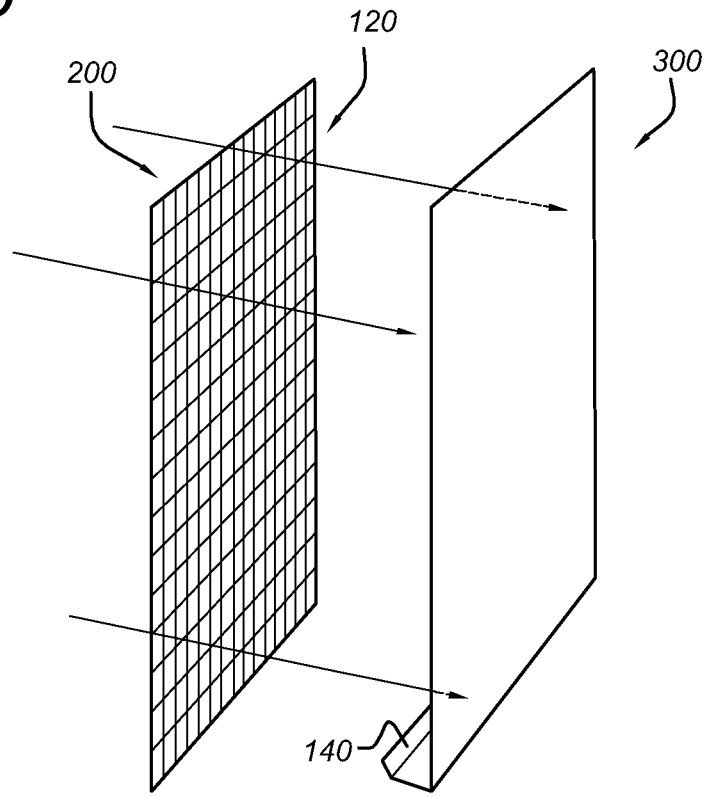

Further, the second electrode 120 may also be used as directional electrode, since due to the presence of the second electrode 120, the fluid, or at least the charged droplets therein, are moved in the direction of the second electrode 120. Hence, the fluid may also penetrate the second electrode 120, and for instance, be received by a receiver arranged to receive the charged droplets. Such receiver may be a plate with a collector. An example thereof is schematically depicted in FIG. 4*b*, wherein the electronic wind may blow through the second electrode 120. Part of the droplets may accumulate at the second electrode 120, but part of it may also penetrate through the second electrode 120 and be accumulated at the receiver, here indicated with reference 300, with for instance collector 140, here in the form of a gutter.

Figure 4C:
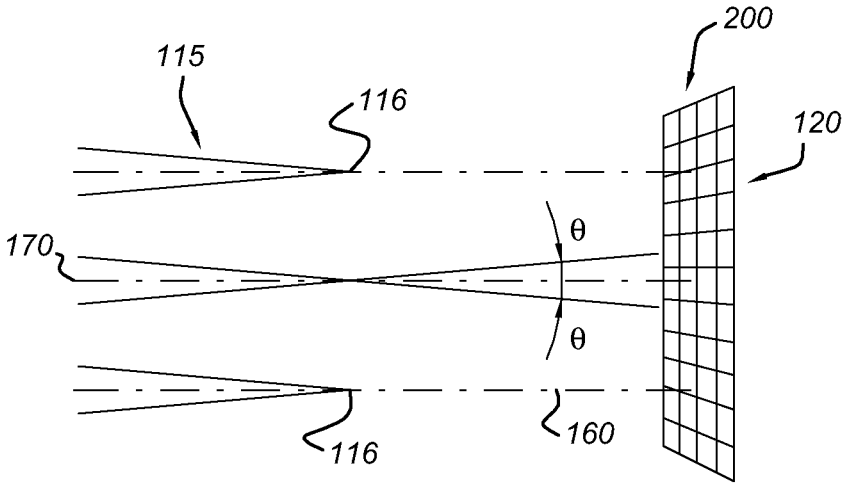

FIG. 4*c* schematically depicts preferred arrangements of the first and the second electrodes 110,120. The first electrode 110 comprises a plurality of needles as curved features 115. Note that the "curve features" may have sharp edges as tips. The term "curved feature" especially indicates that surfaces merge together into a tip, such as in the case of a wedge or a needle. Especially needles are preferred. Such needle may comprise a longitudinal axis or "needle axis", which preferably point in the direction of the second electrode 120. In FIG. 4*c*, the longitudinal axis is indicated with reference 160. Relative to this longitudinal axis 160, in the direction of the tip 116, a virtual cone can be construed, having a cone angle θ. The virtual cone is construed by providing a surface having an angle θ relative to the longitudinal axis 160; a symmetric cone will have an opening angel 2θ. Here the phrase "arranging the curved features (or needles) 115 in such a way that the tips 116 are aligned in the direction of the second electrode 120", and similar phrases, especially indicate that at least part of the second electrode 120 will be arranged within this virtual cone of at least one of the needles. Preferably, especially in the case of a plurality of needles, the cone angle θ is 30°, more preferably 20°, more preferably 10°, even more preferably 5°. This means that within the virtual cone having a cone angle of 10°, the second electrode will be found. In case the second electrode 120 is arranged precisely opposite of the first electrode 110, the longitudinal axis 160 will "intercept" the second electrode. In FIG. 4*c*, a "perpendicular" arrangement of the plurality of needles relative to the second electrode, especially the electrically conductive air permeable sieve 200.

In the case of one single needle, θ may larger, but is preferably smaller than 90°.

Figure 4D:
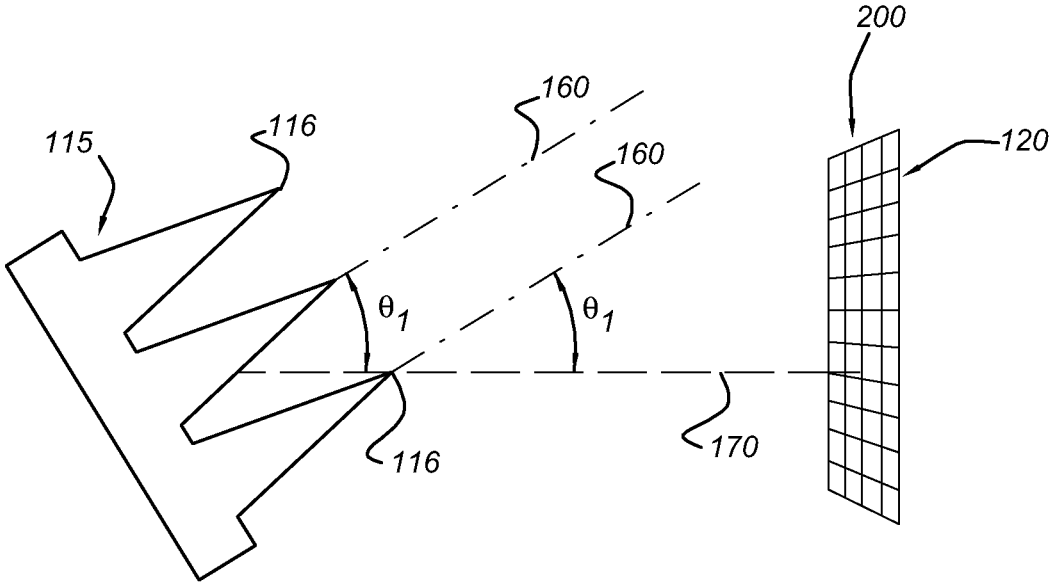

Alternatively, see FIG. 4*d*, the curved features (or needles) needles 115 may point in a direction with an angle θ1, relative to a horizontal 170 starting from the first electrode 115 and extending to the second electrode 120; again, angle θ1 is preferably in the range of 0-30°, more preferably 0-20°, more preferably 0-10°, even more preferably 0-5°. In FIG. 4*c*, angle $\theta_i$ would be 0°. Thus in this (preferred) embodiment, the longitudinal axes 160 have angles $\theta_1$, respectively, which are preferably in the range of 0-30°.

In embodiments wherein a first electrode 110 comprising a plurality of needles is applied, preferably the plurality of needles are aligned substantially parallel (i.e. the longitudinal axes 160 are aligned substantially parallel).

EXAMPLE 1

Mist/Fog Removing Tests

A (STYROFOAM) board was used that was punched through with needles. Each needle is at the back connected to a charge of 15.000 Volts in the test. The styrophome is pure used as insulator and to make the needles straight and erect pointed. The needles are charged stepwise in steps of 1 kV. For the experiment an ordinary fog diffuser (electric water boiler) was applied.

At the level of 6 kV, movement of the fog droplets in the air was observed. The observed movement was approximately 0.5 meters per second. At the level of 7 kV, a total movement of all air borne droplets towards to the counter electrode was observed. As counter electrode, a gauze with a maze of 50 mm was used. The counter electrode was grounded. The observed movement was approx. 1 m/s. At 8 kV, a strong movement of all fog droplets directly towards the gauze. The movement was at least about 3 to 4 m/s. Then, at 9 kV, the same result as mentioned by 8 kVolts was observed; the wind was much stronger. The movement seemed even faster than at 8 kV; about 4-5 meters per second at least. All fog, just after air borne situation, got straight directed to the gauze. At 10 kV the same result as at 9 kV was observed, but only a faster movement towards the gauze.

The test repeated gave the same results.

EXAMPLE 2

Variation of Mesh Size

The mesh size was varied, see the table below,

| Mesh (mm) | Result of droplet removal (visual inspection) |
|---|---|
| 15 | Good |
| 1-2 | Good |
| plate | not air permeable (turbulence at plate) |
| no second electrode | wild turbulence, no fog removal |

EXAMPLE 3

Variation of Distance

Fog source 5 cm distance from first electrode (corona electrode) at the following voltages and distances:

| Voltage (kV) | Distance fog source to second electrode (cm) | Fog capture by second electrode |
|---|---|---|
| 12 | 10 | +/− |
| 16 | 10 | + |
| 16 | 15 | + |
| 16 | 20 | +/− |
| 18 | 20 | + |
| 18 | 25 | + |
| 18 | 30 | + (turbulence) |
| 18 | 35 | − |
| 20 | 35 | + |

EXAMPLE 4

Variation of Angle

The angle of the needles was varied (relative to a horizontal). Results

| Angle of needles 115 relative to horizontal 170 | Short description of needles direction | Fog removal |
|---|---|---|
| 0° | needles point in direction of second electrode 120 | excellent |
| 30° | needles are for instance directed to the ground, under an angle of 30° with the horizontal 170 starting at the first electrode 110 and extending to the second electrode 120 | ok |
| 45° | needles are for instance directed to the ground, under an angle of 45° with the horizontal 170 starting at the first electrode 110 and extending to the second electrode 120 | bad |
| 90° | needles are for instance directed to the ground or in a direction opposite to the ground (vertical direction) | does not work |

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim.

The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage. The term "about" herein, may, especially in numerical embodiments, relate to values within a range of +10% and −10% of the indicated value, especially within a range of +5% and −5% of the indicated value, especially within a range of +2% and −2% of the indicated value. Hence, a value of about 100 kV may indicate 100.0 kV, but may also be within the range of 90-110 kV. This may also apply to numerical values in front whereof the word "about" is not added. Slight deviations may be allowable, as will be clear to the person skilled in the art.

The invention claimed is:

1. A method for the removal of droplets in a gaseous fluid selected from the group consisting of fog, mist, haze, spray and steam, which comprises: applying to the gaseous fluid an electric field in the range of 0.1-100 kV/m between:

(a) first electrode, being a positive electrode comprising a plurality of conductive needles arranged to generate corona discharges; and (b) a second electrode, being an earthed electrode, comprising an air permeable conductive sieve of a plurality of conductive strands having a shortest distance between adjacent conductive strands in the range of 0.01-500 mm;

wherein the plurality of conductive needles are arranged to point in the direction of the second electrode, and wherein the shortest distance between the first electrode and the second electrode is in the range of 5-500 m.

2. The method according to claim 1, wherein the air permeable sieve is conductive wire gauze.

3. The method according to claim 1, wherein at least one of the first and second electrodes are arranged on a motorized vehicle.

4. The method according to claim 1, for reducing fog or mist over one or more geographical objects selected from the group consisting of a road, an open place, a runway, an airstrip and a built-on area.

5. The method according to claim 4, wherein the first electrode comprises a plurality of first electrodes, and wherein the second electrode comprises a plurality of air permeable conductive sieves, and wherein the first electrodes and the plurality of air permeable conductive sieves, are arranged at fixed positions and are arranged to generate the electric field over the one or more geographical objects selected from the group consisting of a road, an open place, a runway, an airstrip and a built-on area.

6. A method for the removal of droplets in a gaseous fluid comprising applying an electric field in the range of 0.1-100 kV/m to the gaseous fluid, wherein the electric field is applied between:

(a) a first electrode, being a positive electrode comprising a plurality of conductive needles arranged to generate corona discharges; and (b) a second electrode, being an earthed electrode, comprising an air permeable conductive sieve of a plurality of conductive strands having a shortest distance between adjacent conductive strands in the range of 0.01-500 mm, wherein the method further comprises arranging the plurality of conductive needles to point in the direction of the second electrode, and wherein the shortest distance between the first electrode and the second electrode is in the range of 5-500 m.

7. The method according to claim 6, wherein the electric field is in the range of about 0.5-100 kV/m.

8. The method according to claim 7, wherein the electric field is in the range of about 4-100 kV/m.

9. The method according to claim 6, wherein the air permeable sieve is a conductive wire gauze.

10. An apparatus for removing droplets from a gaseous fluid, comprising:

(a) a first electrode arranged as a positive electrode comprising a plurality of conductive needles, arranged to generate corona discharges, and arranged to generate an electric field in the range of 0.1-100 kV/m; and (b) a second electrode, being an earthed electrode, comprising an air permeable conductive sieve of a plurality of conductive strands having a shortest distance between adjacent conductive strands in the range of 0.01-500 mm;

wherein the plurality of conductive needles are arranged to point in the direction of the second electrode, and wherein the shortest distance between the first electrode and the second electrode is in the range of 5-500 m.

11. The apparatus according to claim 10, wherein the first electrode comprises a conductive curved feature having one or more dimensions in the range of 0.1 μm-0.5 mM.

12. The apparatus according to claim 10, wherein the air permeable sieve is a conductive wire gauze.

13. The apparatus according to claims 12, wherein the conductive wire gauze comprises meshes with one or more dimensions in the range of 0.01-10 mm.

14. The apparatus according to claim 10, wherein the apparatus further comprises one or more motorized vehicles, wherein the first electrode is arranged on a motorized vehicle, or the second electrode is arranged on a motorized vehicle, or both the first electrode and the second electrode are arranged on motorized vehicles.

15. The apparatus according to claim 10, wherein the first electrode or the second electrode or the first and the second electrode are part of or integrated with an object comprising street furniture.

16. A combination of (a) a road, selected from the group consisting of runways, airstrips, and paved roads for automobiles, and (b) an apparatus according to claim 10 for removing droplets from a gaseous fluid, the apparatus comprising a first electrode arranged to generate a corona discharge and arranged to generate an electric field in the range of 0.1-100 kV/m over at least part of the road.

17. The apparatus according to claim 15, wherein the street furniture comprises a sound barrier, a crash barrier, a tunnel wall, a road sign, a traffic information system, a street lamp, or a traffic light.

* * * * *

UNITED STATES PATENT AND TRADEMARK OFFICE

CERTIFICATE OF CORRECTION

PATENT NO. : 8,425,657 B2
APPLICATION NO. : 12/808736
DATED : April 23, 2013
INVENTOR(S) : Ursem et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 443 days.

Signed and Sealed this
Eighth Day of September, 2015

Michelle K. Lee

Michelle K. Lee
*Director of the United States Patent and Trademark Office*